US008021192B2

(12) United States Patent
Takata

(10) Patent No.: US 8,021,192 B2
(45) Date of Patent: Sep. 20, 2011

(54) LED ILLUMINATION APPARATUS

(75) Inventor: Taketo Takata, Toyama (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 12/815,251

(22) Filed: Jun. 14, 2010

(65) Prior Publication Data

US 2011/0117786 A1 May 19, 2011

(30) Foreign Application Priority Data

Nov. 13, 2009 (JP) ..... 2009-259493
Feb. 11, 2010 (JP) ..... 2010-028309

(51) Int. Cl.
*H01R 31/06* (2006.01)

(52) U.S. Cl. ..... 439/628

(58) Field of Classification Search ..... 439/628, 439/617, 612

See application file for complete search history.

(56) References Cited

U.S. PATENT DOCUMENTS 7,052,171 B1 * 5/2006 Lefebvre et al. ..... 362/649

FOREIGN PATENT DOCUMENTS

JP 2001-351402 A 12/2001
JP 2008-282793 A 9/2008
JP 3148176 U 2/2009

OTHER PUBLICATIONS

Applicants bring the attention of the Examiners to the following pending U.S. Appl. No. 12/815,244, filed Jun. 14, 2010.

* cited by examiner

*Primary Examiner* — Javaid Nasri
(74) *Attorney, Agent, or Firm* — Chen Yoshimura LLP

(57) ABSTRACT

Parts exchange or the like is not easy with an LED illumination apparatus that uses an LED attached to a socket of a conventional fluorescent light fixture. Or if there is no problem in parts exchange, other problems exist such as unfavorable operability and reliability, and necessitating additional parts. Provided herewith is an LED illumination apparatus including: a cap having a terminal electrically coupled to a socket of a fluorescent light fixture; and a main body having an end coupled with the cap, where the main body includes: an LED; and a coupler to electrically couple the terminal to the LED, the coupler being fitted in the cap, the cap includes a cap-side connecting section having flexibility or elasticity to electrically couple the terminal to the coupler, the coupler includes a main-body-side connecting section to electrically couple the LED to the cap-side connecting section, and by means of the flexibility or the elasticity, the cap-side connecting section removably couples the cap to the coupler.

10 Claims, 9 Drawing Sheets

LED ILLUMINATION APPARATUS

BACKGROUND

1. Technical Field

The present invention relates to an LED illumination apparatus that uses an LED (light emitting diode) attached to a socket of a fluorescent light fixture. The contents of the following patent application is incorporated herein by reference, NO. 2009-259493 filed on Nov. 13, 2009, and NO. 2010-028309 filed on Feb. 11, 2010.

2. Related Art

LED illumination apparatuses that use a white LED with high luminance, energy saving capability, and long life have already been developed to replace conventional illumination apparatuses such as fluorescent lamps.

Patent Document No. 1: Japanese Patent Application Publication No. 2001-351402

Patent Document No. 2: Japanese Patent No. 4156657

Patent Document No. 3: Japanese Utility Model Registration No. 3148176

Patent Document No. 1 proposes an LED illumination apparatus that can be attached to an already-installed fluorescent light fixture with ease.

Patent Document No. 2 proposes an LED illumination apparatus that is assembled efficiently.

FIG. 8 shows an internal structure of a conventional LED illumination apparatus. The LED illumination apparatus includes a main body 1, a cap 3, a print substrate 4, a plurality of LEDs 5, and an electric wire 7, where the cap 3 holds a pair of pin terminals 2 attachable to an already-installed fluorescent light fixture and is joined to the main body 1, the print substrate 4 is accommodated in the main body 1 and has an electric control circuitry mounted thereon, the plurality of LEDs 5 are mounted to the print substrate 4, the electric wire 7 has one end connected to the print substrate 4 and the other end connected to the pair of pin terminals 2, and the pair of pin terminals 2 and the electric terminal 7 are connected to each other by swaging or soldering. The connection by waging or soldering is not only difficult to work with, but also the electric wire, once connected, is structurally difficult to be removed, and the parts exchange is difficult to pursue.

Patent Document No. 3 proposes an LED illumination apparatus having an LED illumination section and/or the LED itself exchangeable.

Wiring in some fluorescent light fixtures is such that only one pole of the pair of electrodes of the socket 8 is connected to the power source, as shown in FIG. 9. Therefore, both of the pin terminals 2 should be connected to the print substrate 4. One method to realize this is to connect both of the pin terminals 2 to the print substrate 4 via two electric wires, as shown in FIG. 8. Another method is to connect a round terminal 9*a* to one end of the electric wire 7 drawn from the print substrate 4, to be connected to a pin terminal 2 using screw, as shown in FIGS. 10A and 10B. Note that the round terminal 9*a* and a round terminal 9*b* that is different from the round terminal 9*a* are short circuited therebetween using a jumper line 10, and the round terminal 9*b* is connected to another pin terminal 2 using screw.

There are also a type of fluorescent light fixture that conducts AC-DC conversion therein and supplies a direct current (DC) to an LED illumination apparatus.

SUMMARY

In this way, with a conventional method, parts exchange and the like are difficult. Other problems also exist such as unfavorable operability and reliability, and necessitating additional parts.

So as to solve the above-stated problems, according to a first aspect of the innovations herein, provided is an LED illumination apparatus including: a cap having a terminal electrically coupled to a socket of a fluorescent light fixture; and a main body having an end coupled with the cap, where the main body includes: an LED; and a coupler to electrically couple the terminal to the LED, the coupler being fitted in the cap, the cap includes a cap-side connecting section having flexibility or elasticity to electrically couple the terminal to the coupler, the coupler includes a main-body-side connecting section to electrically couple the LED to the cap-side connecting section, and by means of the flexibility or the elasticity, the cap-side connecting section removably couples the cap to the coupler.

In the above-stated LED illumination apparatus, the cap may include an insertion section to which the coupler is inserted. In the above-stated LED illumination apparatus, the cap-side connecting section and the main-body-side connecting section may be electrically coupled to each other, in a state where the coupler is inserted into the insertion section. In the above-stated LED illumination apparatus, the cap may include a holding section to hold the cap-side connecting section.

The above-stated LED illumination apparatus may be structured such that the main body includes a print substrate provided with the LED and an electric control circuitry, and a part of the print substrate constitutes the coupler. In the above-stated LED illumination apparatus, the cap-side connecting section may be an integrally formed metal plate. The above-stated LED illumination apparatus may be structured such that the terminal is a pair of pin terminals, and the cap-side connecting section electrically couples the pair of pin terminals.

In the above-stated LED illumination apparatus, the cap-side connecting section may include: a substrate connecting spring section that has flexibility or elasticity to be connected to the main-body-side connecting section; and a pin terminal connecting section electrically coupled to the substrate connecting spring section and connected to the terminal. The above-stated LED illumination apparatus may be structured such that the terminal is a pair of pin terminals, the cap-side connecting section includes a pair of pin terminal connecting sections, and each of the pair of pin terminal connecting sections is connected to a respective one of the pair of pin terminals. The above-stated LED illumination apparatus may be structured such that the terminal is a pair of pin terminals, the cap includes a pair of cap-side connecting sections, the coupler includes a pair of main-body-side connecting sections, in one of the pair of cap-side connecting sections, the substrate connecting spring section is connected to one of the pair of main-body-side connecting sections, and the pin terminal connecting section is connected to one of the pair of pin terminals, and in the other of the pair of cap-side connecting sections, the substrate connecting spring section is connected to the other of the pair of main-body-side connecting sections, and the pin terminal connecting section is connected to the other of the pair of pin terminals.

The above structure allows to exchange the parts such as an LED illuminating section and/or the LED itself with ease.

DESCRIPTION OF EXEMPLARY EMBODIMENTS

Figure 1:
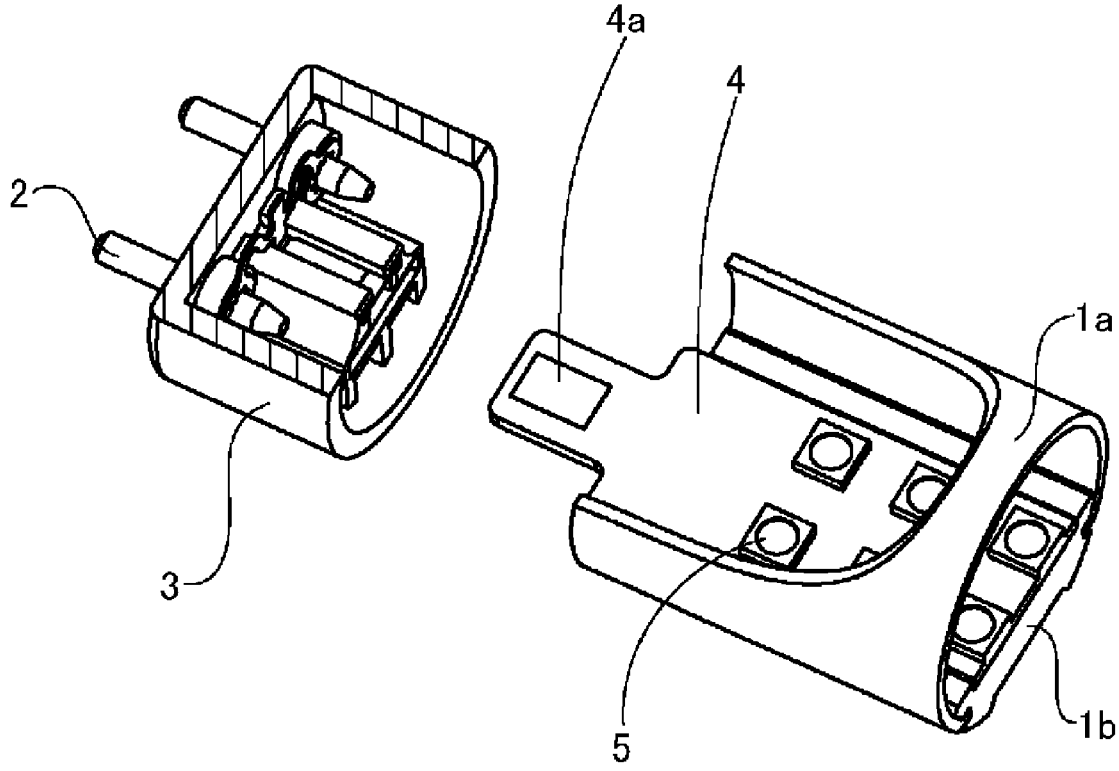
FIG. 1 is an exploded view of an LED illumination apparatus according to the present invention.
Figure 2:
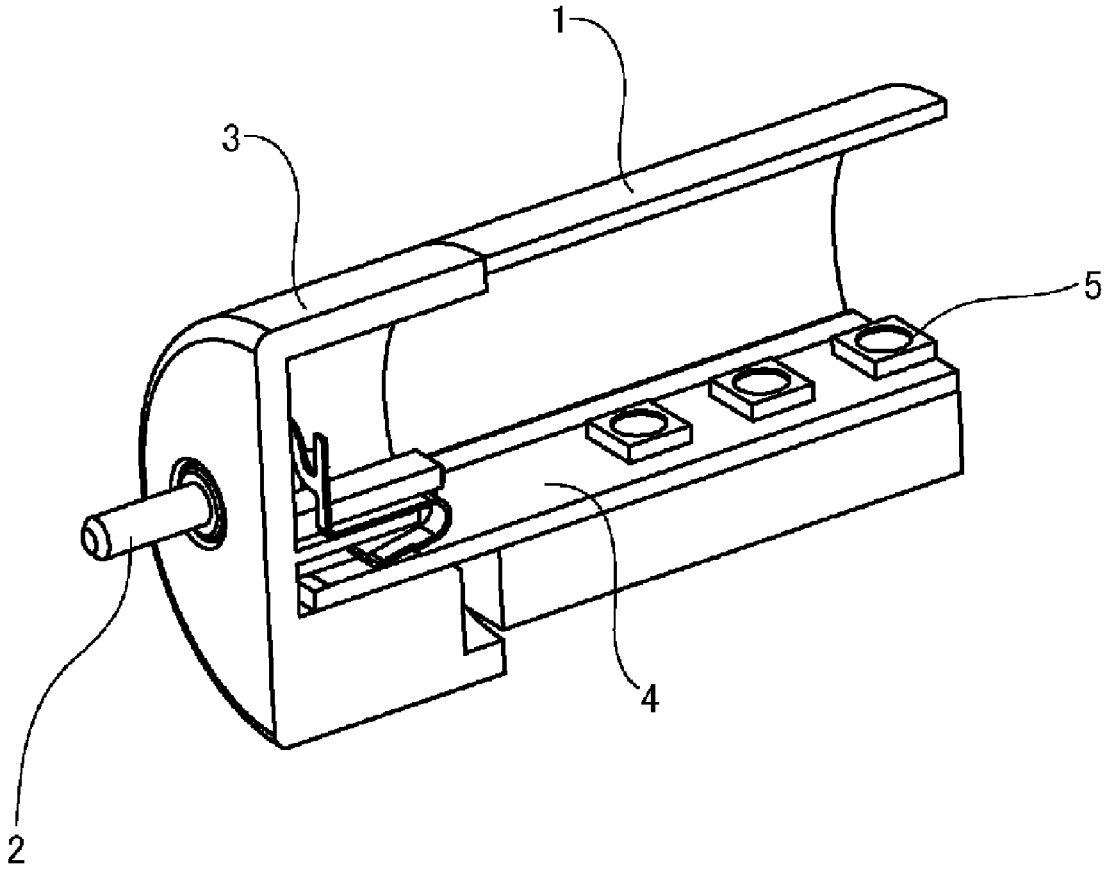
FIG. 2 is a sectional view of the LED illumination apparatus according to the present invention.

As shown in FIG. 1 and FIG. 2, an LED illumination apparatus according to the present embodiment holds a main body 1, a cap 3, a print substrate 4, an LED 5, and a connecting terminal 6, where the cap 3 holds a pair of pin terminals 2 fitted to a socket 8 of a fluorescent light fixture and is joined to the main body 1, the print substrate 4 is accommodated in the main body 1 and has an electric control circuitry mounted thereon, the LED 5 is mounted to the print substrate 4, and the connecting terminal 6 is for connection with the pair of pin terminals 2.

The pair of pin terminals 2 are electrically coupled to the socket 8 of the fluorescent light fixture. The print substrate 4 electrically couples the pair of pin terminals 2 to the LED 5. The print substrate 4 is fitted into the cap 3. The cap 3 and the print substrate 4 are removably coupled to each other. The connecting terminal 6 electrically couples the pin terminal 2 and the print substrate 4. The connecting terminal 6 may be flexible or elastic. By means of the flexibility or the elasticity, the connecting terminal 6 may removably couples the cap 3 with the print substrate 4. The connecting terminal 6 may be an integrally formed metal plate.

The pair of pin terminals 2 may be an example of a terminal coupled to a socket of a fluorescent light fixture. The print substrate 4 may be an example of a coupler. A part of the print substrate 4 may constitute the coupler. The connecting terminal 6 may be an example of a cap-side connecting section.

In the present embodiment, the pair of pin terminals 2 are provided through a cap. However, the pair of pin terminals 2 are not limited to this structure. The pair of pin terminals 2 may include a member fitted to a socket, and a member connected to the connecting terminal 6, so that both of the member fitted to a socket and the member connected to the connecting terminal 6 be electrically coupled to each other.

The term "electrically coupled" or the derivatives thereof may refer to a case where the corresponding members are in contact with each other, and not limited to a case in which the members are electrically connected to each other. The term "electrically coupled" or the derivatives thereof may also include a case where the members form a part of the electric path.

Embodiment Example 1

The main body 1 is a combination between an optical diffusion section 1*a* made of a transparent or semi-transparent resin (e.g. polycarbonate resin) and a heat dissipating section 1*b* made of an aluminum alloy or the like, and has a cylindrical form. However, the heat dissipating section 1*b* may be created as a heat sink having convex and concave portions. Note that the main body 1 is not limited to the described combination, and may be made of only a resin.

Figure 3:
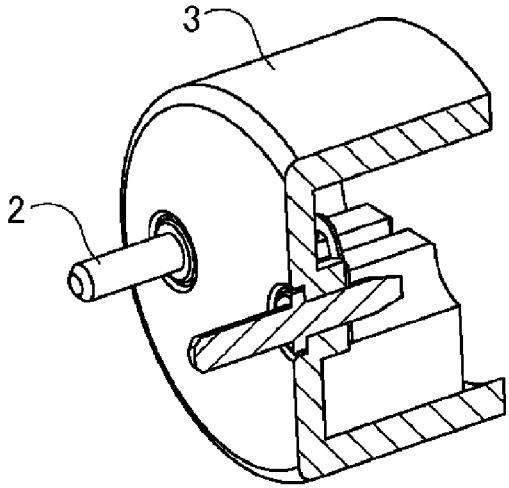
FIG. 3 is a sectional view of a cap 3.
Figure 4:
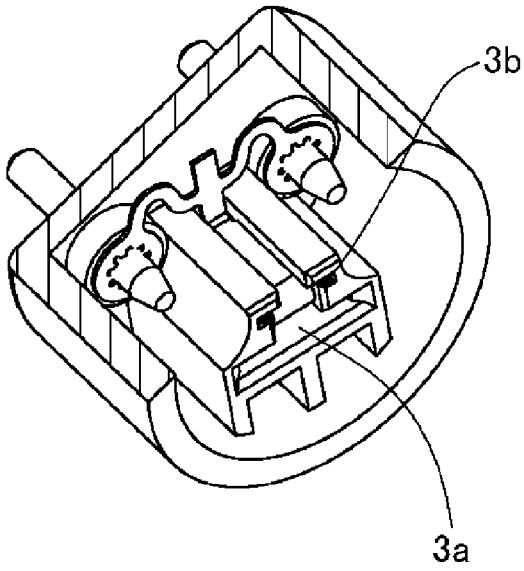
FIG. 4 is an internal perspective view of the cap 3.

The cap 3 having a pair of pin terminals 2 made of a copper alloy sized to suited to an already installed fluorescent light fixture is joined to each end of the main body 1, and has a structure removable from the main body 1 for internal maintenance. Although FIG. 3 shows a cap 3 integrally formed with a pair of pin terminals 2 using an insulation resin, the pair of pin terminals 2 may be attached to the cap 3 by press fit or swaging. In addition, as shown in FIG. 4, a groove 3*b* and a substrate insertion groove 3*a* are formed within the cap 3, where the groove 3*b* is for assembling the connecting terminal 6, and to the substrate insertion groove 3*a*, a circuit connecting section 4*a* of the print substrate 4 to be connected to a substrate connecting spring section 6*a* of the connecting terminal 6 is inserted. Note that the material of the cap 3 may be metal, not limited to an insulation resin, as long as the pin terminal 2 and the cap 3 are electrically insulated from each other for avoiding electric shock.

The print substrate 4 is inserted into the substrate insertion groove 3*a*. The groove 3*b* holds the connecting terminal 6. The circuit connecting section 4*a* electrically couples the LED 5 with the connecting terminal 6. The connecting terminal 6 and the circuit connecting section 4*a* are electrically coupled to each other, in the state where the print substrate 4 is inserted into the substrate insertion groove 3*a*. The substrate insertion groove 3*a* may be an example of an insertion section. The groove 3*b* may be an example of a holding section. The circuit connecting section 4*a* may be an example of a main-body-side connecting section.

The circuit connecting section 4*a* to be connected with the substrate connecting spring section 6*a* of the connecting terminal 6 is formed on the print substrate 4, and an electric control circuitry for rectification and voltage control (not shown in the drawings) and a plurality of LEDs 5 are mounted to the print substrate 4. The circuit connecting section 4 is an electrode of a printed circuit. The print substrate 4 is accommodated in the main body 1. The LEDs 5 in this example are surface-mounting white LEDs, but may be shell-type LEDs. The number of LEDs 5 is defined according to the specification of illumination.

Figure 5:
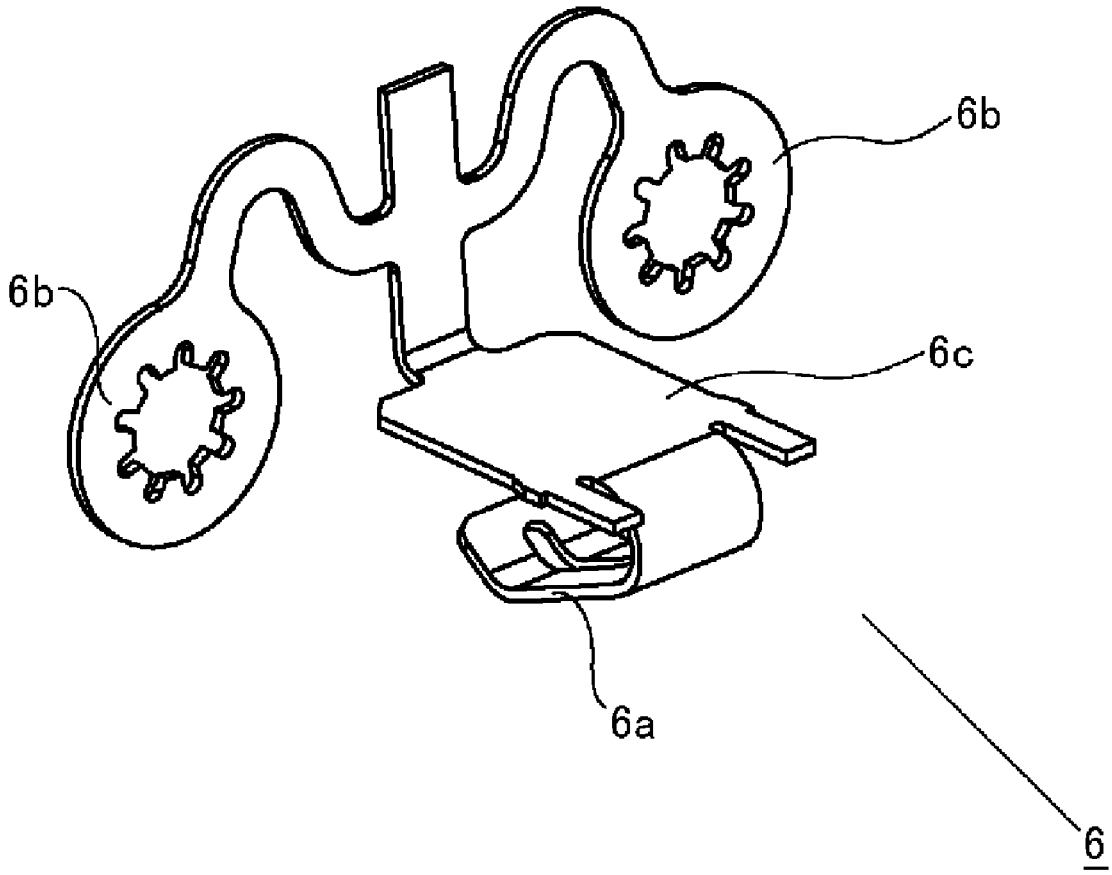
FIG. 5 is a perspective view of a connecting terminal 6.

The connecting terminal 6 is fabricated by press working a copper alloy, and is configured by a substrate connecting spring section 6*a*, pin terminal connecting sections 6*b*, and a base 6*c* as shown in FIG. 5. The base 6*c* is provided with a press-fit section, which is fixed to the groove 3*b* of the cap 3 by press fit. There are two pin terminal connecting sections 6*b* extending from an end of a base 6*c*, to allow connection by inserting the pair of pin terminals 2 therethrough. Note that the pin terminal connecting sections 6*b* have a tooth lock washer shape and have many teeth inside to assuredly connect with the pin terminals 2. The substrate connecting spring section 6*a*, having a U-shape sectional form, is formed to the other end of the base 6*c*, so that it protrudes into the substrate insertion groove 3*a* when fixed to the cap 3. As a result, when the circuit connecting section 4*a* is inserted into the substrate insertion groove 3*a*, the substrate connecting spring section 6*a* is bent to be contact with the circuit connecting section 4*a* to provide electrical connection. The above structure allows to exchange the parts such as an LED illuminating section and/or the LED itself with ease. The pin terminals 2 can be connected to the print substrate 4 with ease using only the connecting terminal 6. This also allows connecting terminal 6 to the pair of pin terminals 2 with a simple structure, without using any additional parts.

Embodiment Example 2

Figure 6:
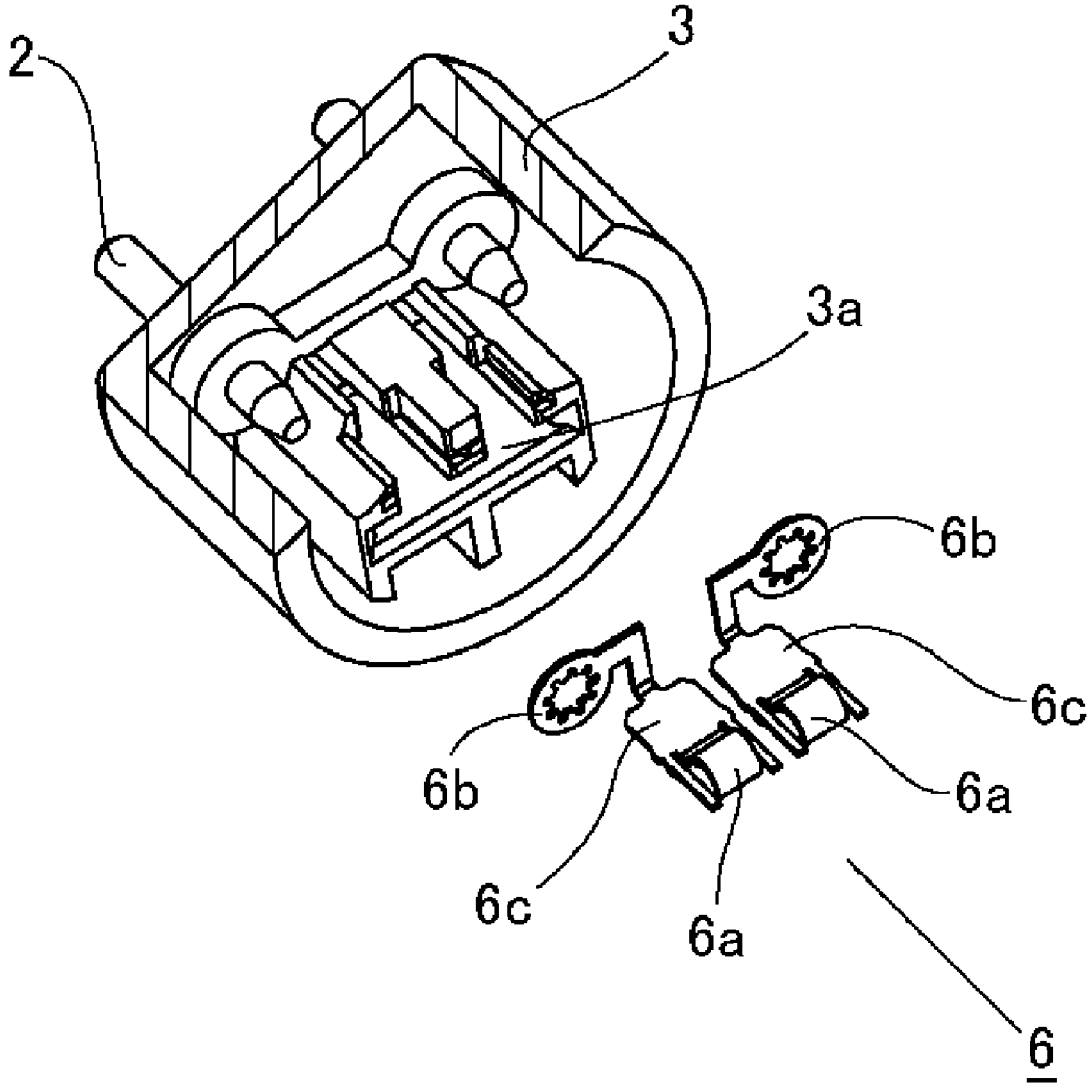
FIG. 6 shows an internal perspective view of a cap 3 and a perspective view of a connecting terminal 6 according to another embodiment example.
Figure 7:
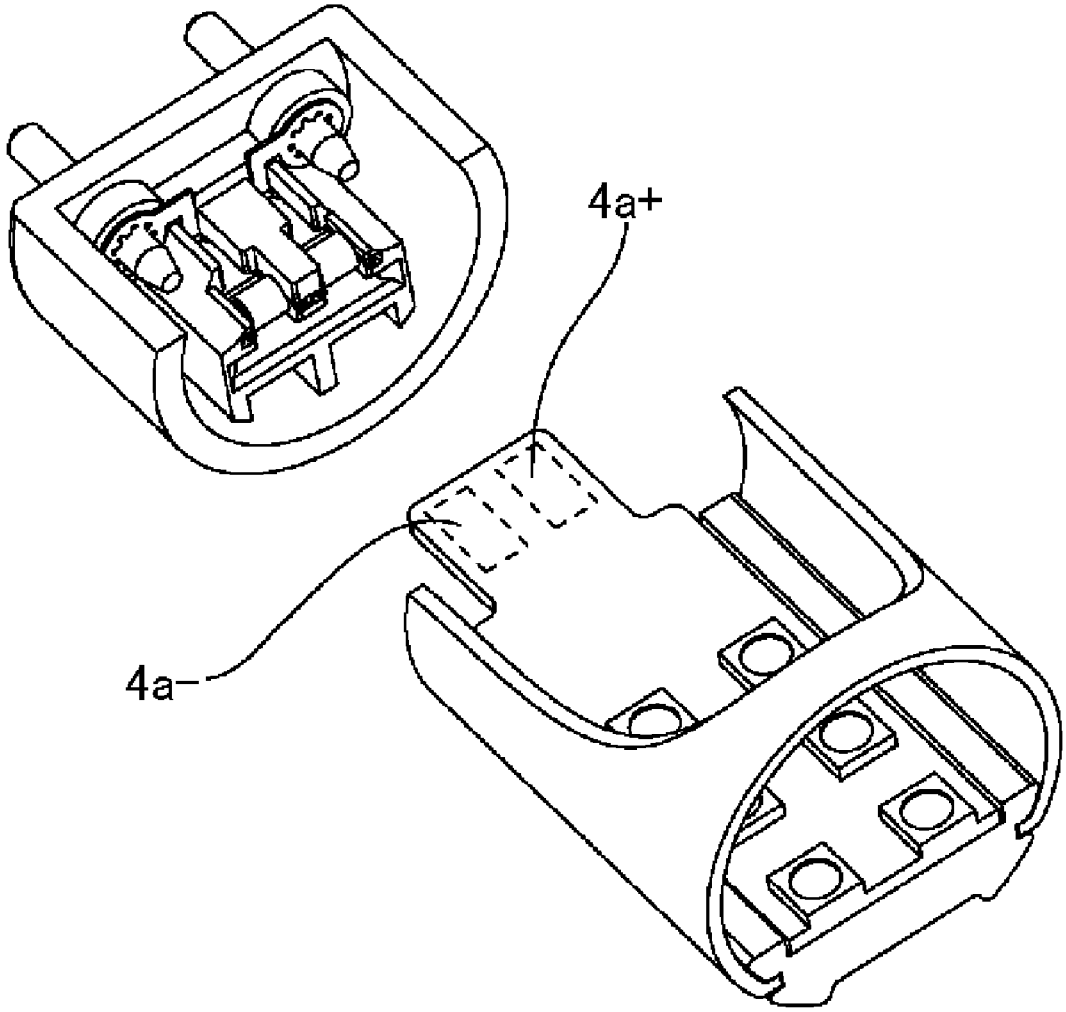
FIG. 7 shows an exploded view of an LED illumination apparatus according to another embodiment example.
Figure 8:
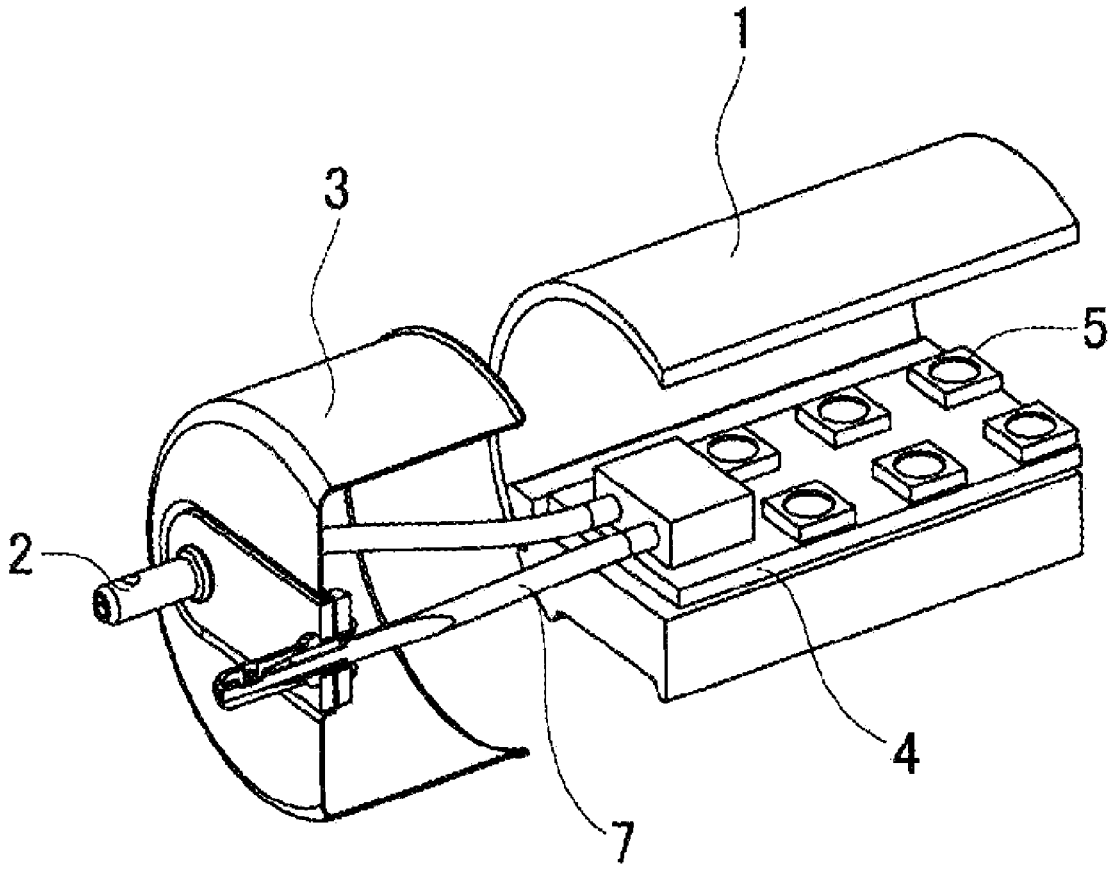
PRIOR ART FIG. 8
FIG. 8 is an exploded sectional view of a conventional LED illumination apparatus.
Figure 9:
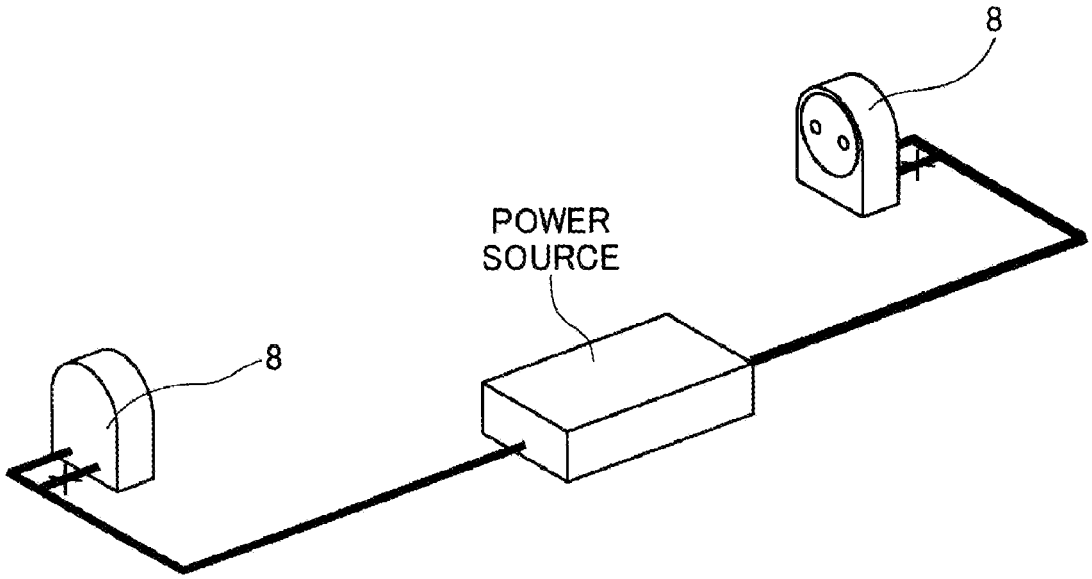
PRIOR ART FIG. 9
FIG. 9 is a wiring diagram of a fluorescent light fixture.
Figure 10A:
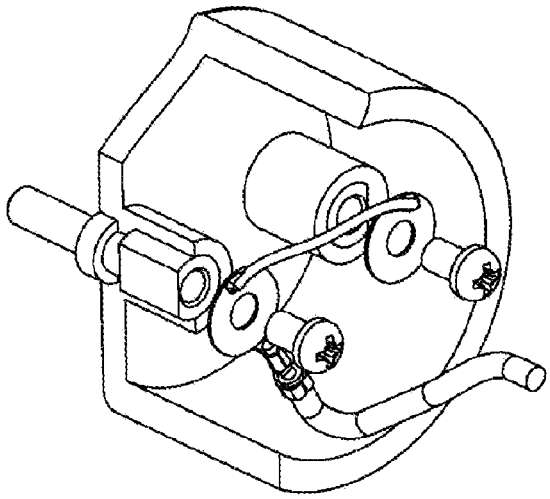
PRIOR ART FIG. 10A
FIGS. 10*a* and 10*b* are a connection diagram for a conventional LED illumination apparatus.
Figure 10B:
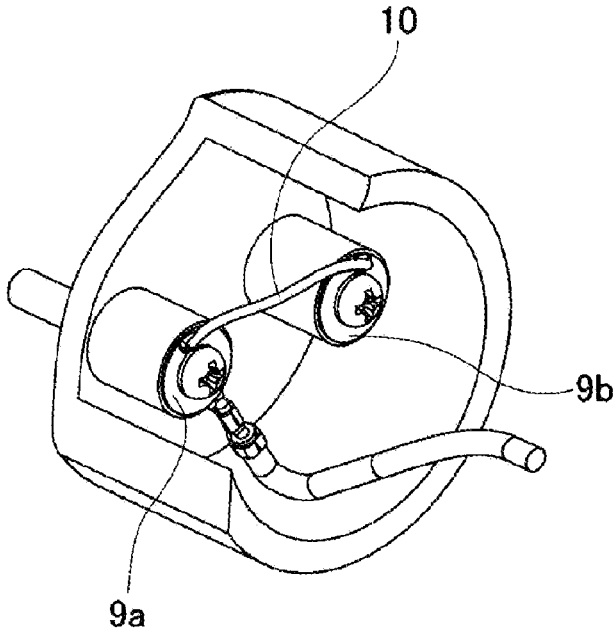
PRIOR ART FIG. 10B

Embodiment Example 2 involves an invention corresponding to a type of illumination conducting AC-DC conversion in a fluorescent light fixture and supplying a direct current (DC) to an LED illumination apparatus. The following explains a configuration different from Embodiment Example 1, with reference to FIGS. 6 and 7.

An anode 4*a*+ and a cathode 4*a*− are formed on the circuit connecting section 4*a* of the print substrate 4. Two connecting terminals 6 are provided for one of the caps 3 of the main body 1, for respectively connecting to the anode 4*a*+ and the cathode 4*a*−. The pin terminals provided for the other cap 3 at the other end of the main body 1 are a so-called dummy, which does not electrically function.

The connecting terminal 6 of Embodiment Example 2 is configured by substrate connecting spring sections 6*a*, pin terminal connecting sections 6*b*, and bases 6*c*. A base 6*c* is provided with a press-fit section, which is fixed to the groove 3*b* of the cap 3 by press fit. There are two pin terminal connecting sections 6*b* extending from an end of a base 6*c*, to allow connection by inserting the pair of pin terminals 2 therethrough. Note that the pin terminal connecting sections 6*b* have a tooth lock washer shape and have many teeth inside to assuredly connect with the pin terminal 2. A substrate connecting spring sections 6*a*, having a U-shape sectional form, is formed to the other end of each base 6*c*, so that it protrudes into the substrate insertion groove 3*a* when fixed to the cap 3. As a result, when the substrate insertion groove 3*a* is inserted into the circuit connecting section 4*a*, the substrate connecting spring section 6*a* is bent to be contact with the circuit connecting section 4*a* to provide electrical connection. This structure can be applied to a type of fluorescent light fixture that supplies a direct current with a simple structure.

The present invention relates to an LED illumination apparatus that uses an LED (light emitting diode) attached to a socket of a fluorescent light fixture.

What is claimed is:

1. An LED illumination apparatus comprising:

a cap having a terminal configured to be electrically coupled to a socket of a fluorescent light fixture; and a main body having an end configured to be coupled with the cap, wherein the main body includes:

an LED; and a coupler to electrically couple the terminal to the LED, the coupler being fitted in the cap, the cap includes a cap-side connecting section having flexibility or elasticity to electrically couple the terminal to the coupler, the coupler includes a main-body-side connecting section to electrically couple the LED to the cap-side connecting section, and by means of the flexibility or the elasticity of the cap-side connecting section, the cap-side connecting section removably couples the cap to the coupler.

2. The LED illumination apparatus according to claim 1, wherein the cap includes an insertion section to which the coupler is inserted.

3. The LED illumination apparatus according to claim 2, wherein the cap-side connecting section and the main-body-side connecting section are electrically coupled to each other, in a state where the coupler is inserted into the insertion section.

4. The LED illumination apparatus according to claim 1, wherein the cap includes a holding section to hold the cap-side connecting section.

5. The LED illumination apparatus according to claim 1, wherein the main body includes a print substrate provided with the LED and an electric control circuitry, and a part of the print substrate constitutes the coupler.

6. The LED illumination apparatus according to claim 1, wherein the cap-side connecting section is an integrally formed metal plate.

7. The LED illumination apparatus according to claim 1, wherein the terminal is a pair of pin terminals, and the cap-side connecting section electrically couples the pair of pin terminals.

8. The LED illumination apparatus according to claim 1, wherein the cap-side connecting section includes:

a substrate connecting spring section that has flexibility or elasticity to be connected to the main-body-side connecting section; and a pin terminal connecting section electrically coupled to the substrate connecting spring section and connected to the terminal.

9. The LED illumination apparatus according to claim 8, wherein the terminal is a pair of pin terminals, the cap-side connecting section includes a pair of pin terminal connecting sections, and each of the pair of pin terminal connecting sections is connected to a respective one of the pair of pin terminals.

10. The LED illumination apparatus according to claim 8, wherein the terminal is a pair of pin terminals, the cap includes a pair of cap-side connecting sections, the coupler includes a pair of main-body-side connecting sections, in one of the pair of cap-side connecting sections, the substrate connecting spring section is connected to one of the pair of main-body-side connecting sections, and the pin terminal connecting section is connected to one of the pair of pin terminals, and in the other of the pair of cap-side connecting sections, the substrate connecting spring section is connected to the other of the pair of main-body-side connecting sections, and the pin terminal connecting section is connected to the other of the pair of pin terminals.

* * * * *